US007624476B1

(12) United States Patent
Lin

(10) Patent No.: US 7,624,476 B1
(45) Date of Patent: Dec. 1, 2009

(54) AUTOMATIC CLOSING ASSEMBLY FOR A SLIDING DOOR

(76) Inventor: Kun-Long Lin, No. 79, Lane 36, Sec. 2, Tansing Rd., Tanzih Hsiang, Taichung Hsien (TW)

( * ) Notice: Subject to any disclaimer, the term of this patent is extended or adjusted under 35 U.S.C. 154(b) by 0 days.

(21) Appl. No.: 12/220,405

(22) Filed: Jul. 24, 2008

(51) Int. Cl.
*E05F 1/08* (2006.01)

(52) U.S. Cl. ..... 16/79; 16/71; 49/421; 160/214

(58) Field of Classification Search ..... 16/79, 16/71–72, 82, 85, DIG. 21; 49/404; 220/345.1, 220/348; 160/214
See application file for complete search history.

(56) References Cited

U.S. PATENT DOCUMENTS 3,918,201 A * 11/1975 Graziano ..... 49/28
4,003,102 A * 1/1977 Hawks et al. ..... 16/72
4,891,911 A * 1/1990 Yung ..... 49/404
6,633,094 B1 * 10/2003 Andou ..... 307/326
7,025,106 B2 * 4/2006 Donnelly ..... 160/90
2005/0082021 A1 * 4/2005 Manning ..... 160/371
2007/0186481 A1 * 8/2007 Tomita et al. ..... 49/409
2008/0210385 A1 * 9/2008 Sawyers et al. ..... 160/31
2008/0250716 A1 * 10/2008 Ranaudo et al. ..... 49/31

* cited by examiner

*Primary Examiner*—William L. Miller

(57) ABSTRACT

An automatic closing assembly for a sliding door has a base, an adjusting device and a housing. The base is mounted on the sliding door and has a mounting bracket and a connecting frame. The connecting frame is mounted on the mounting bracket and has a damper barrel. The adjusting device is connected to the base and has a handle, a screw shaft, and a resilient device. The handle is rotatably connected to the base and rotates the screw shaft. The resilient device moveably engages the screw shaft and is selectively retracted by rotation thereof. The housing is telescopically connected to the base, is mounted around the adjusting device and comprises two tubes connected respectively to ends of the resilient device to transmit a returning force to the door.

12 Claims, 6 Drawing Sheets

AUTOMATIC CLOSING ASSEMBLY FOR A SLIDING DOOR

BACKGROUND OF THE INVENTION

1. Field of the Invention

The present invention relates to an automatic closing assembly, and more particularly relates to an automatic closing assembly for a sliding door that has an adjustable returning force to return an opened sliding door easily and smoothly.

2. Description of Related Art

Generally, a user must manually apply a force to open or close a sliding door. Therefore, to open or to close a sliding door is inconvenient especially when something is being carried. Furthermore, when a sliding door is not closed completely, insects or dust may go through the door causing irritation to those inside.

To keep a sliding door closed completely, a conventional automatic closing assembly is mounted on the sliding door to provide an auto-returning function to the sliding door. The conventional closing assembly has multiple pipes and a resilient device. The pipes are mounted on a top of the sliding door. The resilient device is mounted in the pipes to provide a returning force for closing the sliding door.

However, the conventional automatic closing assembly for a sliding door has the following shortcomings.

1. The size and the weight of sliding doors vary, and the conventional closing assembly requires a different returning force of the resilient device to provide a suitable returning force for closing a corresponding sliding door. Then, manufacturing multiple kinds of the resilient device of the conventional closing assembly is necessary and this will increase the cost of using the conventional closing assembly.

2. Each conventional closing assembly with the resilient device only can provide a particular returning force and be used in a particular size and weight of the sliding door. Therefore, the conventional closing assembly cannot adjust for different kinds of the sliding door or tailored to provide a stronger or weaker returning force depending on application.

3. The returning force of the resilient device of the conventional closing assembly may wear down after a long time and cannot provide a sufficient returning force to the sliding door. Then the conventional closing assembly requires replacement and increases maintenance costs.

Therefore, the invention provides an automatic closing assembly for a siding door to mitigate or obviate the aforementioned problems.

SUMMARY OF THE INVENTION

The main objective of the present invention is to provide an automatic closing assembly for a sliding door that can close a door automatically and has an easily adjustable returning force.

The automatic closing assembly for a sliding door in accordance with the present invention has a base, an adjusting device and a housing. The base is mounted on the sliding door and has a mounting bracket and a connecting frame. The connecting frame is mounted on the mounting bracket and has a damper barrel. The adjusting device is connected to the base and has a handle, a transmitting segment, a screw shaft, at least one supporting rod and a resilient device. The handle is rotatably connected to the base. The transmitting segment is rotatably mounted in the damper barrel and is securely connected to the handle. The screw shaft is connected to the transmitting segment and is rotated by the handle. The at least one supporting rod is securely connected to the damper barrel parallel to the screw shaft. The resilient device moveably engages the screw shaft and is selectively retracted by rotation thereof. The housing is telescopically connected to the base, is mounted around the adjusting device and comprises two tubes connected respectively to ends of the resilient device to transmit a returning force to the door.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
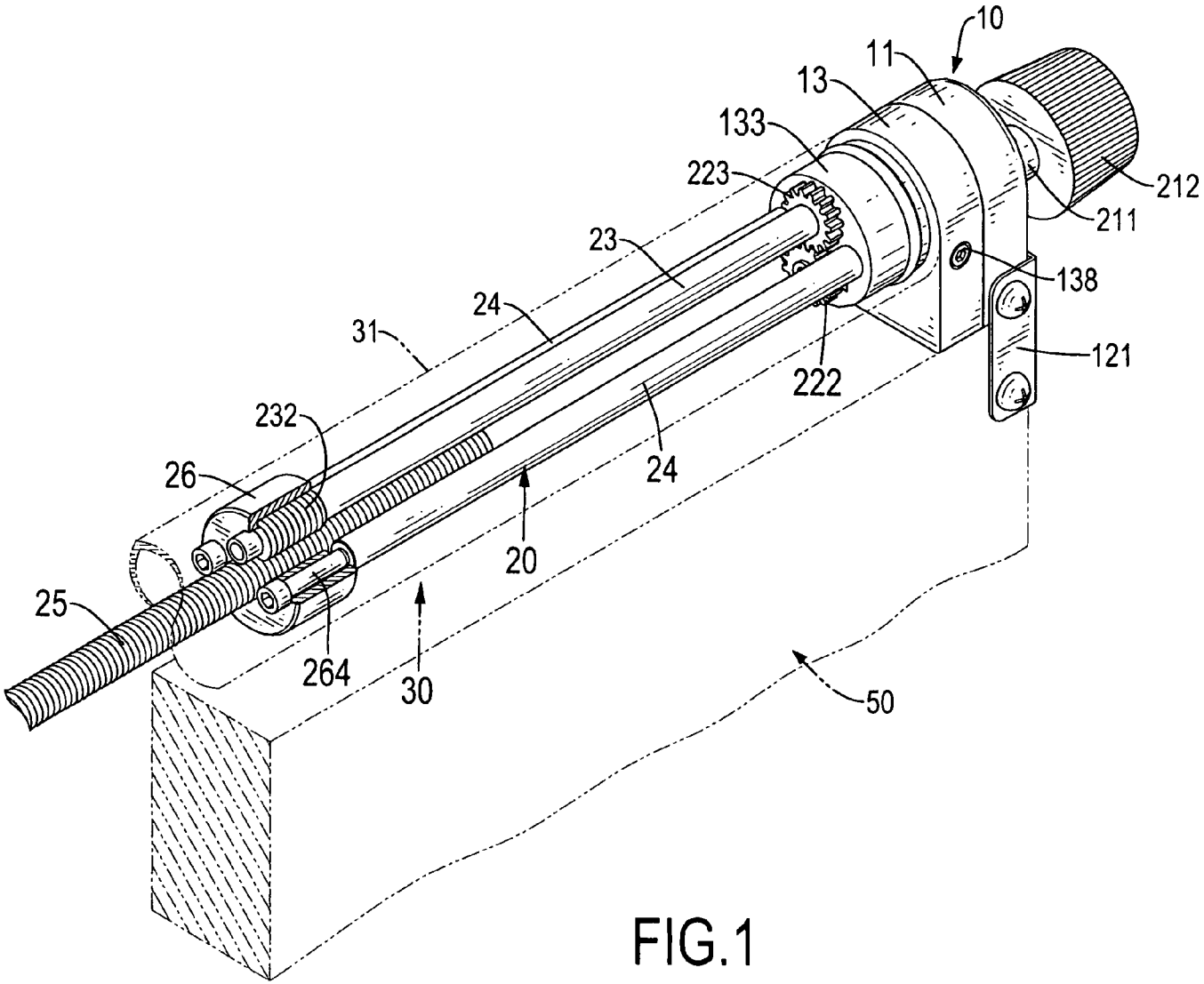
FIG. 1 is a perspective view of an automatic closing assembly in accordance with the present invention mounted on a sliding door.
Figure 2:
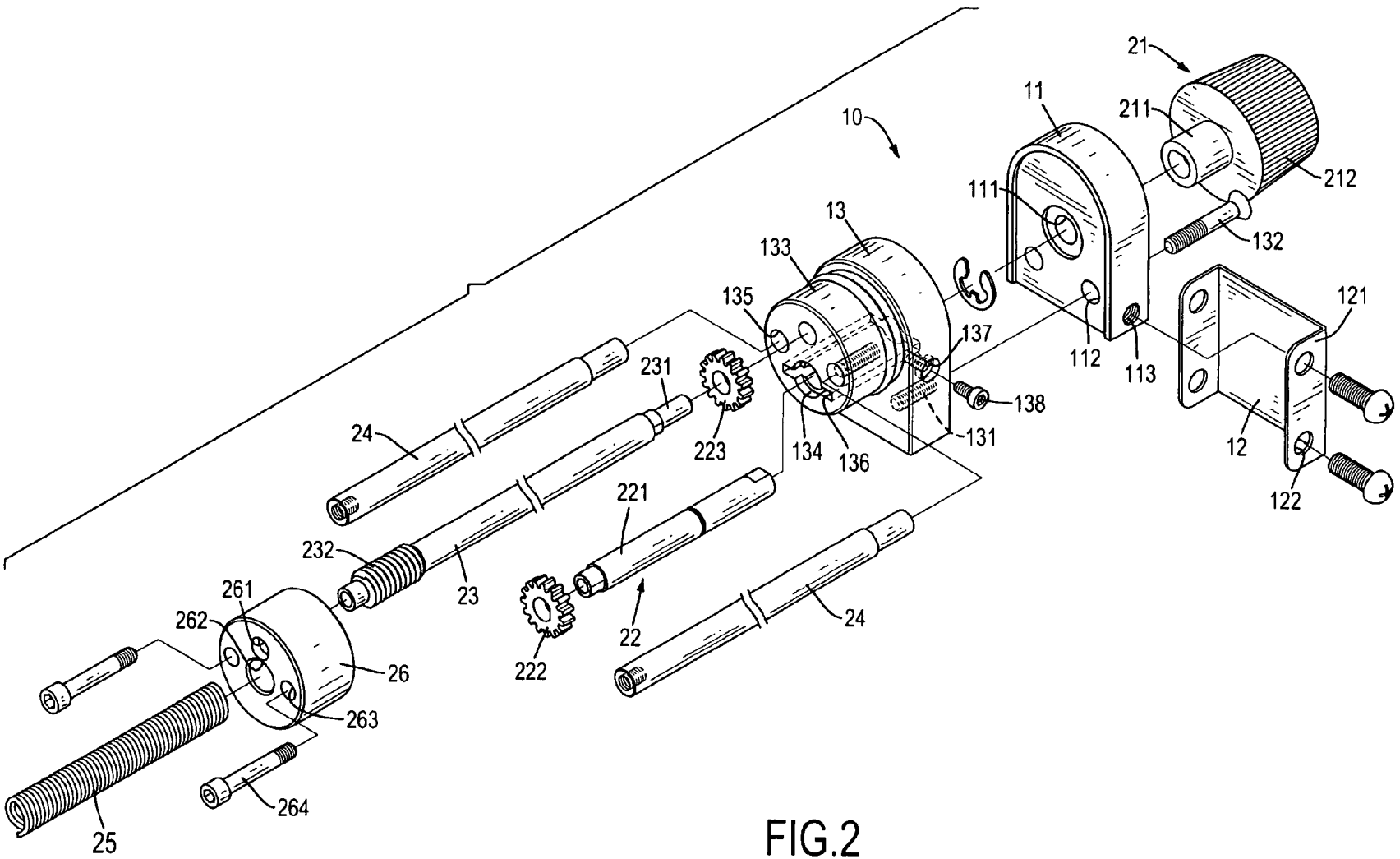
FIG. 2 is an exploded perspective view of the automatic closing assembly in FIG. 1.
Figure 3:
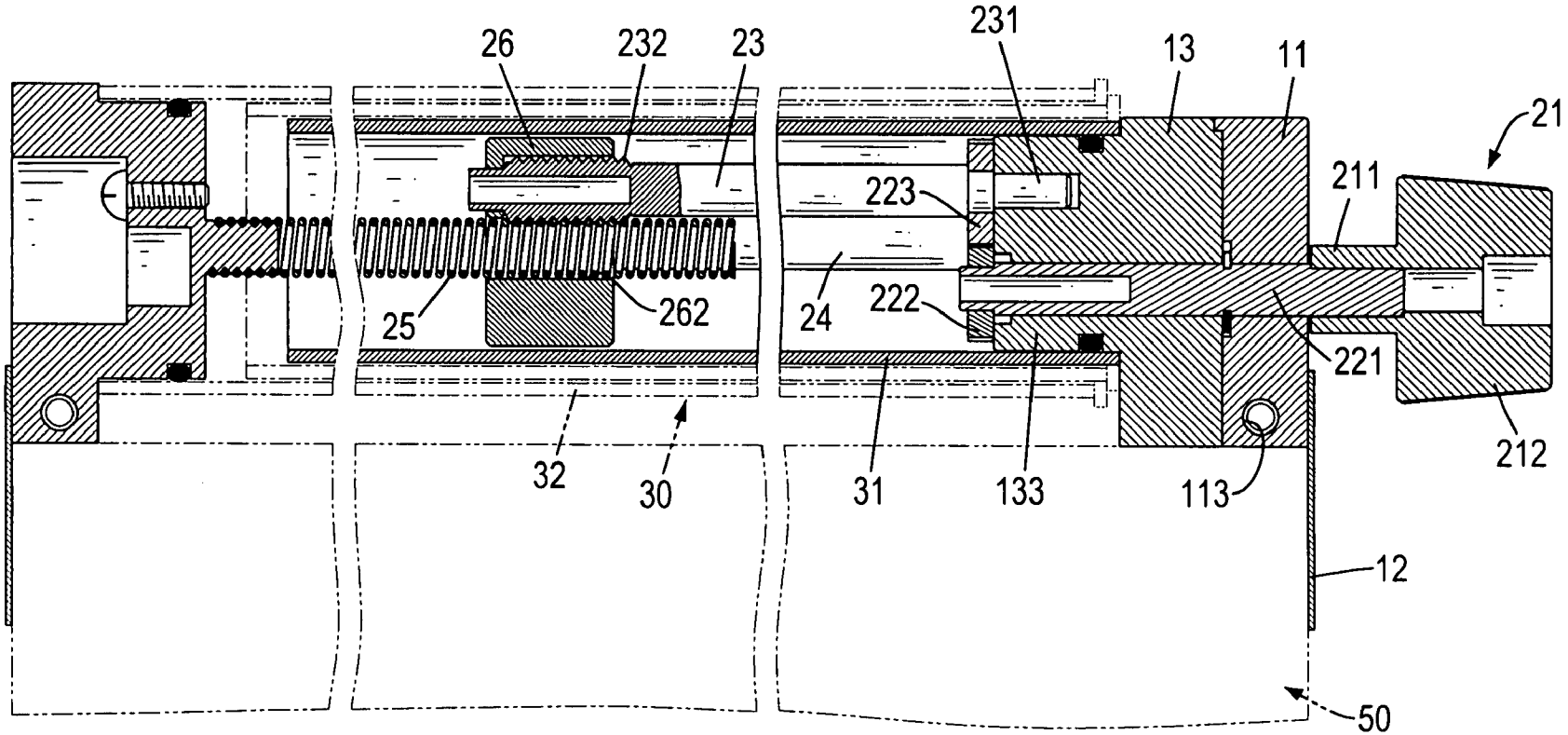
FIG. 3 is a side view in partial section of the automatic closing assembly in FIG. 1.

With reference to FIGS. 1 to 4, an automatic closing assembly in accordance with the present invention is used on a sliding door (50) having a top and two side surfaces, and comprises a base (10), an adjusting device (20) and a housing (30).

The base (10) is mounted on the sliding door (50) and has a mounting bracket (11), a linking frame (12) and a connecting frame (13).

The mounting bracket (11) is mounted on the top of the sliding door (50) and has a bottom, an inner side, two sidewalls, a pipe hole (111), two through holes (112) and two mounting holes (113). The bottom of the mounting bracket (11) is mounted on the top of the sliding door (50). The pipe hole (111) is formed through the mounting bracket (11). The through holes (112) are formed through the mounting bracket (11) near the bottom. The mounting holes (113) are respectively formed in the sidewalls of the mounting bracket (11). The linking frame (12) may be U-shaped, is connected to the mounting bracket (11) and the sliding door (50) using fasteners to mount the mounting bracket (11) securely on the sliding door (50) and has two opposite edges, two linking tabs (121) and multiple linking holes (122). The linking tabs (121) are respectively formed on the opposite edges of the linking frame (12). The linking holes (122) are formed through the linking frame (12) and two of the linking holes (122) align with the mounting holes (113) on the mounting bracket (11). The fasteners are mounted through the corresponding linking holes (122) in the linking frame (12) and in the mounting holes (113) of the mounting bracket (11) and may be screws, set screws, bolts, nails or the like.

The connecting frame (13) is mounted on the inner side of the mounting bracket (11) and has an inner surface, an outer surface, a sidewall, a top, a bottom, two threaded holes (131), two mounting fasteners (132), a damper barrel (133), a release hole (137) and an adjustment fastener (138). The outer surface of the connecting frame (13) abuts the inner side of the mounting bracket (11). The threaded holes (131) are formed in the outer surface of the connecting frame (13) near the bottom and align with the through holes (112) in the mounting bracket (11). The mounting fasteners (132) are respectively mounted through corresponding through holes (112) of the mounting bracket (11) and are mounted securely in the threaded holes (131) in the connecting frame (13) to connect the connecting frame (13) with the mounting bracket (11). The release hole (137) is formed through the sidewall of the connecting frame (13) above one of the threaded holes (131). The adjustment fastener (138) is mounted in the release hole (137).

The damper barrel (133) is formed on and protrudes from the inner surface of the connecting frame (13) near the top and has an inner side, an axle hole (134), at least one rod hole (135), and a chamber (136). The axle hole (134) is formed through the inner side of the damper barrel (133) and the connecting frame (13) and aligns with the pipe hole (111) of the mounting bracket (11). The at least one rod hole (135) is formed in the inner side of the damper barrel (133). In a preferred embodiment, two rod holes (135) are implemented. The chamber (136) is formed in the damper barrel (133) and the connecting frame (13) and communicates with the axle hole (134) and the release hole (137) of the connecting frame (13) to allow air to flow out of the base (10) from the release hole (137).

The adjusting device (20) is connected to the base (10) and has a handle (21), a transmitting segment (22), a screw shaft (23), at least one supporting rod (24), a resilient device (25) and a holding jacket (26).

The handle (21) is rotatably connected to the mounting bracket (11) and the connecting frame (13) of the base (10) and has an inner end, an outer end, a connecting pipe (211) and an annular grip (212). The connecting pipe (211) is defined in the inner end of the handle (21). The annular grip (212) is defined in the outer end of the handle (21). When rotating the annular grip (212), the connecting pipe (211) is rotated relative to mounting bracket (11) and the connecting frame (13).

Figure 5:
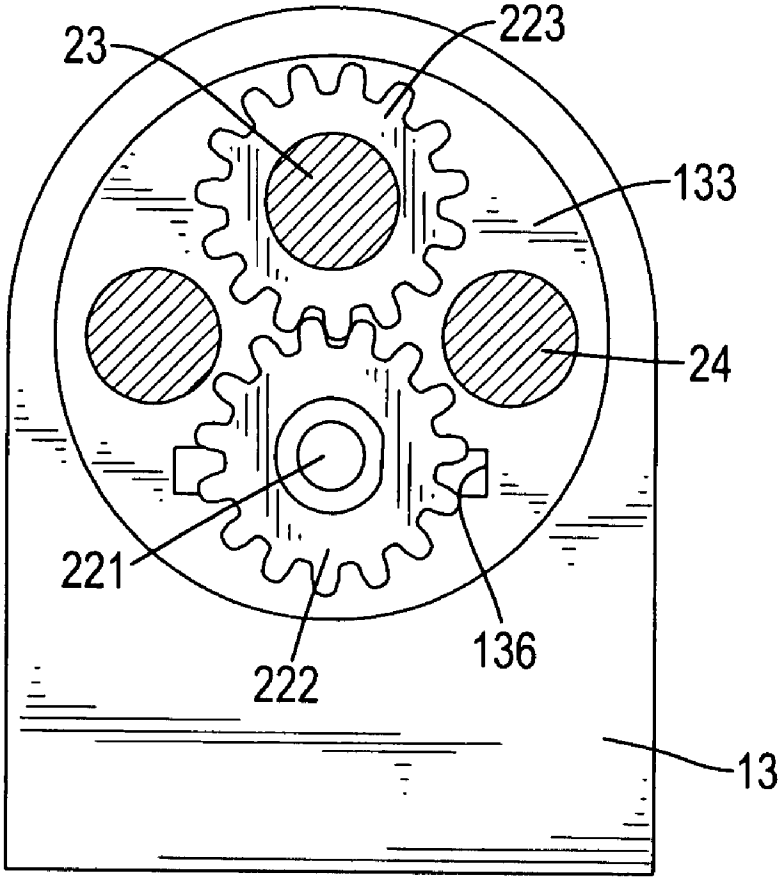
FIG. 5 is an end view in partial section of a transmitting segment of the automatic closing assembly in FIG. 1.

With further reference to FIG. 5, the transmitting segment (22) is rotatably mounted in the damper barrel (133) of the connecting frame (13), is securely connected to the handle (21) and has a transmitting axle (221), a driving gear (222) and a transmitting gear (223). The transmitting axle (221) is rotatably mounted in the axle hole (134) of the damper barrel (133) and the pipe hole (111) of the mounting bracket (11) and securely mounted in the handle (20) and has an inner end and an outer end. The outer end of the transmitting axle (221) is securely connected to the connecting pipe (211) of the handle (21). The inner end of the transmitting axle (221) extends out of the inner side of the damper barrel (133). The driving gear (222) is mounted around the inner end of the transmitting axle (221). The transmitting gear (223) is rotatably mounted on the inner side of the damper barrel (133) and engages the driving gear (222). When the driving gear (222) rotates relative to the damper barrel (133) by the handle (21) rotating the transmitting axle (221), the transmitting gear (223) will rotate relative to the damper barrel (133).

The screw shaft (23) is connected to the transmitting segment (22) and has a connecting end (231) and a screwing end (232). The connecting end (231) of the screw shaft (23) is securely connected to the transmitting segment (22), may be to the transmitting gear (223) of the transmitting segment (22) and may be mounted rotatably in the damper barrel (133).

The at least one supporting rod (24) is securely mounted in the damper barrel (133) parallel to the screw shaft (23) and has a proximal end and a distal end. The proximal end of the at least one supporting rod (24) is securely mounted in the rod hole (135) of the damper barrel (133). In the preferred embodiment two supporting rods (24) are implemented to prevent rotation and improve stability.

The resilient device (25) moveably engages the screw shaft (23) adjacent to the at least one supporting rod (24) and has an inner end and an outer end. The inner end of the resilient device (25) is disposed adjacent to and engages the screwing end (232) of the screw shaft (23) near the distal end of the at least one supporting rod (24).

Figure 6:
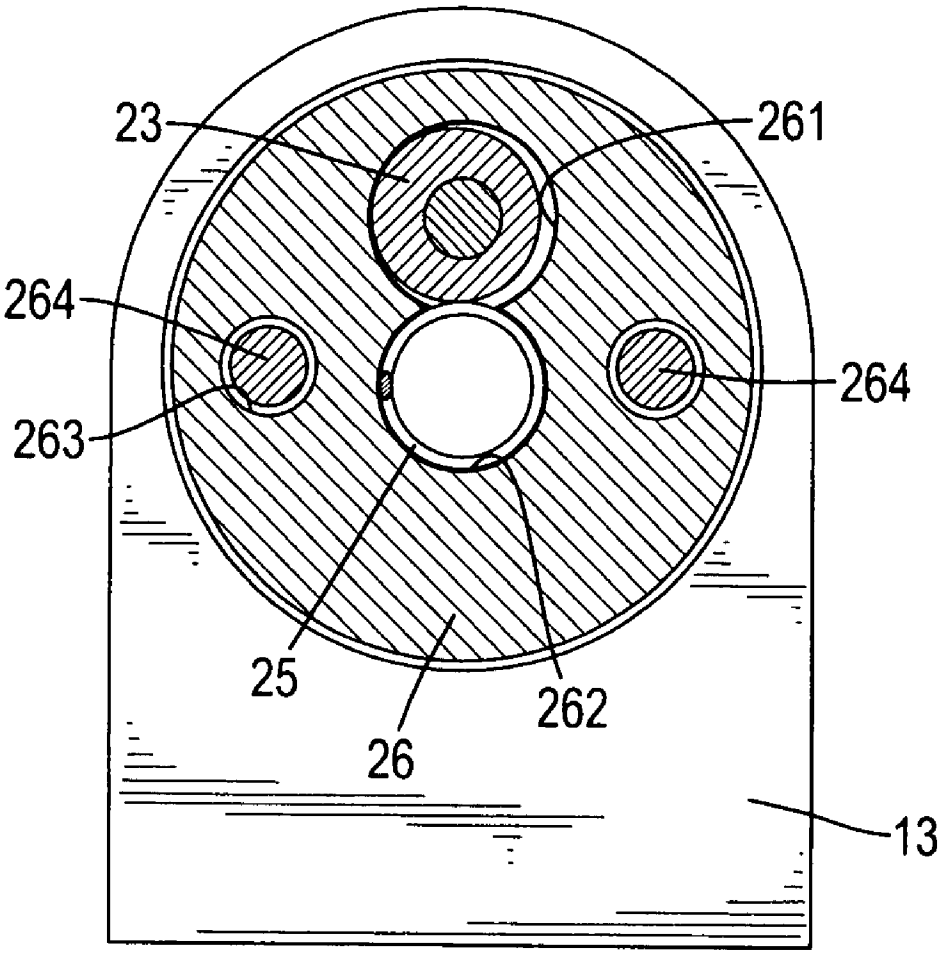
FIG. 6 is a cross sectional end view of a holding jacket of the automatic closing assembly in FIG. 1.

With further reference to FIG. 6, the holding jacket (26) is mounted around the screw shaft (23), the at least one supporting rod (24) and the resilient device (25) and has a shaft hole (261), an adjusting hole (262), at least one holding hole (263) and fasteners (264). The shaft hole (261) is formed through the holding jacket (26) and is mounted rotatably around the screw shaft (23). The adjusting hole (262) is formed through the holding jacket (26), communicates with the shaft hole (261) and is mounted movably around the resilient device (25) to ensure the resilient device (25) engages the screw shaft (23). Each holding hole (263) is formed through the holding jacket (26) near the adjusting hole (262) and aligns with one rod hole (135) of the damper barrel (133) and is mounted around the distal end of one supporting rod (24). In the preferred embodiment, two holding holes (263) are implemented. The fasteners (264) are mounted in the shaft hole (261) and the at least one holding hole (263) and are respectively connected to the screwing end (232) of the screw shaft (23) and the distal end of the at least one supporting rod (24) to secure the holding jacket (26) relative to the damper barrel (133). In the preferred embodiment, three fasteners (264) are implemented.

The housing (30) is telescopically connected to the base (10), is mounted around the adjusting device (20) and has an inner tube (31) and at least one outer tube (32). The inner tube (31) is mounted securely around the damper barrel (133) of the connecting frame (13). The at least one outer tube (32) is movably mounted around the inner tube (31), is securely mounted on the sliding door (50) and connected to the outer end of the resilient device (25) through a base.

Figure 4:
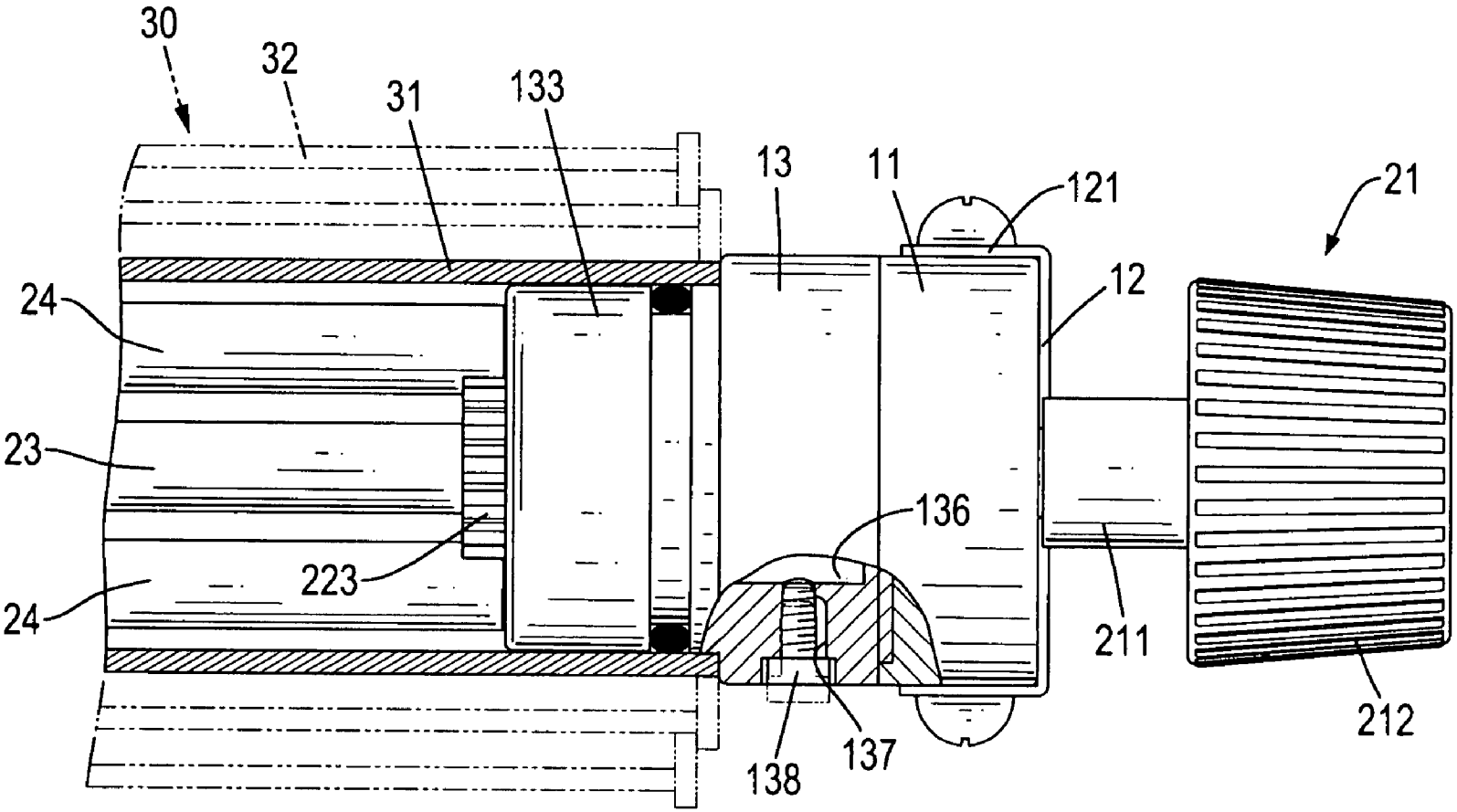
FIG. 4 is a top view in partial section of the automatic closing assembly in FIG. 1.

When assembling the automatic closing assembly on a sliding door (50), a user can adjust a returning force of the resilient device (25) by rotating the annular grip (212) of the handle (21) to make the screw shaft (23) rotate via the transmitting segment (22) to retract or extend the spring (25) and provide a different returning force to the housing (30). Then, the automatic closing assembly can be implemented on various sliding doors (50) of different size and weight by adjusting the returning force of the resilient device (25) to close the sliding door (50) automatically. When the at least one outer tube (32) moves relative to the inner tube (31), the air in the housing (10) drains through the chamber (136) of the damper barrel (133) and flows out of the base (10) from the release hole (137) of the connecting frame (13). A flow rate of air and therefore a dampening force can be adjusted by rotating the adjustment fastener (138) in the release hole (137) as shown in FIG. 4.

The automatic closing assembly for a sliding door (50) in accordance with the present invention has the following advantages:

1. The automatic closing assembly can close the sliding door (50) automatically by means of the returning force provided by the resilient device (25) pulling the at least one outer tube (32) to move relative to the inner tube (31) and close the sliding door (50), which is convenient even when objects are being carried.

2. The returning force of the resilient device (25) can be adjusted for use with sliding doors (50) of different size and weight. Therefore, manufacturing costs of the automatic closing assembly are decreased by economies of scale.

3. Once the spring (25) loses elasticity due to metal fatigue, the handle (21) can be adjusted to adjust the returning force of the resilient device (25) to provide a sufficient returning force to close the sliding door. Consequently, a life of the automatic closing assembly will be longer than a conventional automatic closing assembly and cost of maintenance is decreased.

4. The flow rate of air can be adjusted by rotating the adjustment fastener (138) in the release hole (137) to change a moving speed of the sliding door (50).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. An automatic closing assembly for a sliding door having a top and two side surfaces, and the automatic closing assembly having a base having a mounting bracket being adapted to mount on the top of the sliding door and having a bottom being adapted to mount on the top of the sliding door;

an inner side;

two sidewalls; and a pipe hole being formed through the mounting bracket; and a connecting frame being mounted on the inner side of the mounting bracket and having an inner surface;

an outer surface abutting the inner side of the mounting bracket;

a sidewall;

a top;

a bottom; and a damper barrel being formed on and protruding from the inner surface of the connecting frame near the top and having an inner side;

an axle hole being formed through the inner side of the damper barrel and the connecting frame and aligning with the pipe hole of the mounting bracket; and at least one rod hole being formed in the inner side of the damper barrel;

an adjusting device being connected to the base and having a handle being rotatably connected to the mounting bracket and the connecting frame of the base and having an inner end; and an outer end;

a transmitting segment being rotatably mounted in the damper barrel of the connecting frame and being securely connected to the handle;

a screw shaft being connected to the transmitting segment and having a connecting end being securely connected to the transmitting segment; and a screwing end;

at least one supporting rod being securely mounted in the damper barrel, being parallel to the screw shaft and each one of the at least one supporting rod having a proximal end being securely mounted in one of the at least one rod hole of the damper barrel; and a distal end; and a resilient device moveably engaging the screw shaft adjacent to the at least one supporting rod and having an inner end being disposed adjacent to and engaging the screwing end of the screw shaft; and an outer end; and a housing being telescopically connected to the base, being mounted around the adjusting device and having an inner tube being mounted securely around the damper barrel of the connecting frame; and at least one outer tube being movably mounted around the inner tube, being adapted to securely mount on the sliding door and one of the at least one outer tube being connected to the outer end of the resilient device.

2. The automatic closing assembly as claimed in claim 1, wherein the adjusting device further has a holding jacket being mounted around the screw shaft, the at least one supporting rod and the resilient device and having a shaft hole being formed through the holding jacket and being mounted rotatably around the screw shaft;

an adjusting hole being formed through the holding jacket and communicating with the shaft hole and being mounted movably around the resilient device;

at least one holding hole being formed through the holding jacket near the adjusting hole and aligning with the at least one rod hole of the damper barrel and the distal end of the at least one supporting rod being respectively connected to the at least one holding hole; and multiple fasteners being mounted in the shaft hole and the at least one holding hole and being respectively connected to the screwing end of the screw shaft and the distal end of the at least one supporting rod to connect the holding jacket with the damper barrel.

3. The automatic closing assembly as claimed in claim 2, wherein the handle further has a connecting pipe being defined in the inner end of the handle; and an annular grip being defined in the outer end of the handle;

the transmitting segment further has a transmitting axle being rotatably mounted in the axle hole of the damper barrel and the pipe hole of the mounting bracket and securely mounted in the handle and having an outer end being securely connected to the connecting pipe of the handle; and an inner end extending out of the inner side of the damper barrel;

a driving gear being mounted around the inner end of the transmitting axle; and a transmitting gear being rotatably mounted on the inner side of the damper barrel and engaging the driving gear; and the connecting end of the screw shaft is securely connected to the transmitting gear of the transmitting segment.

4. The automatic closing assembly as claimed in claim 3, wherein the damper barrel has two rod holes being formed in the inner side of the damper barrel;

the adjusting device has two supporting rods being securely mounted in the rod holes of the damper barrel; and the holding jacket has two holding holes being formed through the holding jacket near the adjusting hole and aligning with the rod holes of the damper barrel and the distal ends of the supporting rods being respectively connected to the holding holes; and three fasteners being mounted in the shaft hole and the holding holes and being respectively connected to the screwing end of the screw shaft and the distal ends of the supporting rods to connect the holding jacket with the damper barrel.

5. The automatic closing assembly as claimed in claim 4, wherein the mounting bracket further has two mounting holes being respectively formed in the sidewalls of the mounting bracket; and the base further has a linking frame being U-shaped, being connected to the mounting bracket and the sliding door to hold the mounting bracket with the sliding door using fasteners and having two opposite edges;

two linking tabs being respectively formed on the opposite edges of the linking frame; and multiple linking holes being formed through the linking tabs and two of the linking holes aligning with the mounting holes on the mounting bracket and the fasteners being extended through the corresponding linking holes and mounted in the mounting holes on the mounting bracket.

6. The automatic closing assembly as claimed in claim 5, wherein the mounting bracket further has two through holes being formed through the mounting bracket near the bottom; and the connecting frame further has two threaded holes being formed in the outer surface of the connecting frame near the bottom and aligning with the through holes in the mounting bracket; and two mounting fasteners being respectively mounted through corresponding through holes of the mounting bracket and being mounted securely in the threaded holes in the connecting frame to connect the connecting frame with the mounting bracket.

7. The automatic closing assembly as claimed in claim 6, wherein the connecting frame further has a release hole being formed through the sidewall of the connecting frame above one of the threaded holes; and an adjustment fastener being mounted in the release hole; and the damper barrel further has a chamber formed in the damper barrel and the connecting frame and communicating with the axle hole and the release hole of the connecting frame to controllably allow air to flow out of the base from the release hole.

8. The automatic closing assembly as claimed in claim 1, wherein the handle further has a connecting pipe being defined in the inner end of the handle; and an annular grip being defined in the outer end of the handle;

the transmitting segment further has a transmitting axle being rotatably mounted in the axle hole of the damper barrel and the pipe hole of the mounting bracket and securely mounted in the handle and having an outer end being securely connected to the connecting pipe of the handle; and an inner end extending out of the inner side of the damper barrel;

a driving gear being mounted around the inner end of the transmitting axle; and a transmitting gear being rotatably mounted on the inner side of the damper barrel and engaging the driving gear; and the connecting end of the screw shaft is securely connected to the transmitting gear of the transmitting segment.

9. The automatic closing assembly as claimed in claim 1, wherein the damper barrel has two rod holes being formed in the inner side of the damper barrel; and the adjusting device has two supporting rods being securely mounted in the rod holes of the damper barrel.

10. The automatic closing assembly as claimed in claim 1, wherein the mounting bracket further has two mounting holes being respectively formed in the sidewalls of the mounting bracket; and the base further has a linking frame being U-shaped, being connected to the mounting bracket and tile sliding door to hold the mounting bracket with the sliding door using fasteners and having two opposite edges;

two linking tabs being respectively formed on the opposite edges of the linking frame; and multiple linking holes being formed through the linking tabs and two of the linking holes aligning with the mounting holes on the mounting bracket and the fasteners being extended through the corresponding linking holes and mounted in the mounting holes on the mounting bracket.

11. The automatic closing assembly as claimed in claim 1, wherein the mounting bracket further has two through holes being formed through the mounting bracket near the bottom; and the connecting frame further has two threaded holes being formed in the outer surface of the connecting frame near the bottom and aligning with the through holes in the mounting bracket; and two mounting fasteners being respectively mounted through corresponding through holes of the mounting bracket and being mounted securely in the threaded holes in the connecting frame to connect the connecting frame with the mounting bracket.

12. The automatic closing assembly as claimed in claim 1, wherein the connecting frame further has a release hole being formed through the sidewall of the connecting frame; and an adjustment fastener being mounted in the release hole; and the damper barrel further has a chamber formed in the damper barrel and the connecting frame and communicating with the axle hole and the release hole of the connecting frame to controllably allow air to flow out of the base from the release hole.

* * * * *